US008769888B2

(12) United States Patent
Burger

(10) Patent No.: US 8,769,888 B2
(45) Date of Patent: Jul. 8, 2014

(54) PROTECTIVE ASSEMBLY FOR DOORS, WINDOWS AND THE LIKE

(76) Inventor: Harold Burger, Boca Raton, FL (US)

( * ) Notice: Subject to any disclaimer, the term of this patent is extended or adjusted under 35 U.S.C. 154(b) by 70 days.

(21) Appl. No.: 12/930,472

(22) Filed: Jan. 10, 2011

(65) Prior Publication Data

US 2012/0174507 A1 Jul. 12, 2012

(51) Int. Cl.
*E06B 3/26* (2006.01)

(52) U.S. Cl.
USPC ..... 52/202; 52/203

(58) Field of Classification Search
USPC ..... 52/202, 106, 107, 203
See application file for complete search history.

(56) References Cited

U.S. PATENT DOCUMENTS

| | | | | |
|---|---|---|---|---|
| 5,603,183 | A | 2/1997 | Giovinazzi | |
| 5,911,660 | A | 6/1999 | Watson | |
| 6,330,768 | B1 | 12/2001 | Rodrigues | |
| 6,363,670 | B1 * | 4/2002 | Dewitt | 52/202 |
| 6,910,312 | B2 | 6/2005 | Whitworth | |
| 2009/0094896 | A1 | 4/2009 | Quick et al. | |

* cited by examiner

*Primary Examiner* — Basil Katcheves
(74) *Attorney, Agent, or Firm* — Melvin K. Silverman

(57) ABSTRACT

A protection assembly for covering a window/door, said protection assembly comprising at least one rigid protective panel dimensioned to fit against a frame of said window/door; at least one protecting member for supporting said at least one rigid protective panel against said frame of said window/door; and at least one coupling member for coupling said at least one rigid protective panel against said frame of said window/door, and for further securing said at least one protecting member against said at least one rigid protective panel.

9 Claims, 8 Drawing Sheets

PROTECTIVE ASSEMBLY FOR DOORS, WINDOWS AND THE LIKE

FIELD OF THE INVENTION

Embodiments of the present invention generally relate to covering means, and, more particularly, to protect assemblies for covering and protecting doors, windows and the like.

BACKGROUND OF THE INVENTION

Storm shutters have been employed to protect windows and doors during a storm. These storm shutters includes panels which may be attached to the outer window frame by hinges, nails or screws. However, the shutter louvers have one or more apertures between the louver slats which permit air and sunlight to enter the structure, consequently protection provided by the shutter louvers is limited by the strength of the individual horizontal louver slats. Further, the louver slats having an opening between adjacent slats cannot provide sufficient protection against large magnitude storms such as hurricanes.

Currently, numerous panel systems are commercially available in the art which require considerable amount of time to install. Installation procedures includes separating the male and female member from each other, laying each track separately onto the window casing, then nailing the tracks into place, and then re-snapping the main frame back together with the secure male or female unit on the window casing. However, if the tracking system is not perfectly aligned to the dimensions of the main frame receiver, the main frame will not snap back into the tracking system correctly upon completion of the installation causing air infiltration through the main frame, and damage to the tracking system due to misalignment. Some other panel systems are heavy systems which are very costly.

The prior art, as known to the Applicant, includes various cumbersome, costly and difficult to use devices having as their object, the wind protection of windows and sliding doors of buildings. Such prior art is reflected in U.S. Application Publication US2009/0094896 (2009) to Quick, entitled Apparatus for Protection of Building Openings. This disclosure entails the use of complex mechanical parts which therefore operate to degrade the reliability and the cost-effectiveness of such systems.

A so-called storm brace assembly is taught in U.S. Pat. No. 6,910,312 (2005) to Withworth. This structure is also mechanically complex and does not lend itself to ready use or application by a home owner.

A window storm panel brace is taught by U.S. Pat. No. 6,330,768 (2001) to Rodriquez. Rodriquez, which entails the use of many critical and difficult to manufacture and assemble parts which, as such, render it impractical for use by a typical home owner.

U.S. Pat. No. 5,603,183 (1997) to Giovinazzi, entitled Window Security Device teaches a window securement system in which the securement elements, unlike that of the prior art, and Applicant's invention, entails primary securement bars. As such, its utility is mainly that of security as opposed to wind protection.

U.S. Pat. No. 5,911,660 (1991) to Watson teaches a storm window panel. The teaching of Watson is that of a panel only which, in concept, could be used as a protective panel in any of the storm window protection systems shown in the prior art, and Applicant's. However, the structure of Watson is complex and requires special purpose molding in order to manufacture and, as such, does not represent a practical solution for most home owners.

Accordingly, there remains a need in the art to overcome the problems with the prior art as discussed above, and particularly for a more cost effective and efficient way for to provide protection to doors and window during a storm.

SUMMARY OF THE INVENTION

In accordance with an embodiment of the present invention, a protection assembly for covering a window/door includes, a rigid protective panel dimensioned to fit against a frame of the window/door, multiple protecting members for supporting the rigid protective panel against the frame of the window/door, and multiple coupling members for coupling the rigid protective panel against the frame of the window/door, and for further securing the protecting member against the rigid protective panel.

In accordance with another embodiment of the present invention, a protection assembly for covering a window/door includes, a rigid protective panel dimensioned to fit against the window/door, one or more protecting members for supporting the rigid protective panel against the window/door, and multiple latches positioned on the window/door for securing the protecting members against the rigid protective panel. The assembly may further include multiple hooks positioned on the window/door for supporting the rigid protective panel against the frame of the window/door.

It is an object of the invention to provide an apparatus or system for the retention of wind protection panels in the frame opening of a window or door of a building.

It is another object to provide an apparatus for retention of protective panels within a window or building structure for use without complicated parts, equipment or requirements for use with skilled labor.

It is a further object of the instant invention to provide an apparatus for retaining a protective panel in a building opening structure in which members are formed of spring-like or resilient material formed within a complemental female recess to thereby prevent slippage of tension bar members within the frame of the structure openings.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
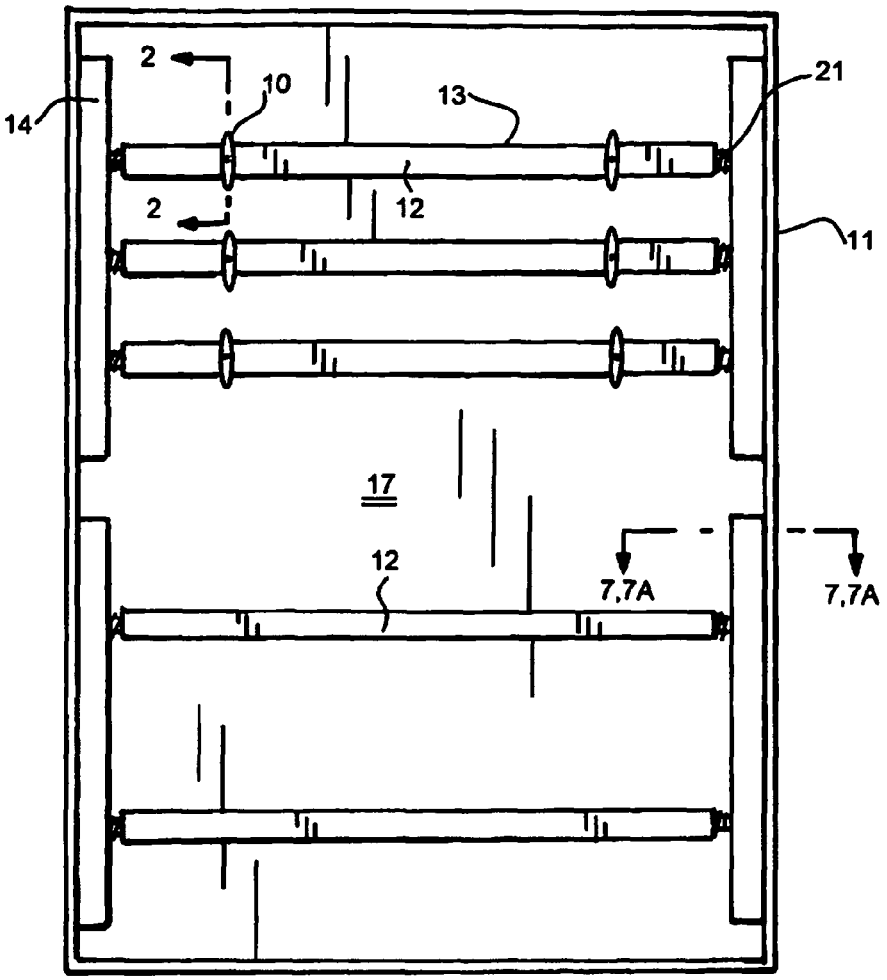
FIG. 1 is a front view of a protection assembly for covering a window/door, according to an embodiment of the invention.
Figure 2:
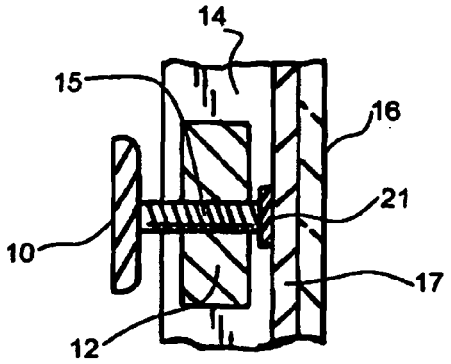
FIG. 2 is a cross sectional view of a fastener securing a protecting member to the protection assembly for covering a window/door, according to an embodiment of the invention.

With reference to FIGS. 1-6, a protection assembly for covering a window in accordance with certain embodiments of the present invention, generally includes, a rigid protective panel 17 dimensioned to fit against a jamb or frame 11 of the window or door. Multiple angle irons 14 support the rigid protective panel 17 against the jamb 11 of the window. Coupling or securing of the rigid protective panel 17 against the frame 11 may be accomplished through a combination of two separate strategies, the first being the use of elongate members 12 and 12' shown in FIGS. 1 to 4. In FIGS. 1 and 2, the elongate members 12 are rectangular in cross-section, while in FIGS. 3 and 4 the elongate members 12' are circular in cross-sections, i.e., 12' are poles. In each type of elongate member, ends 21 of the members fit into holes 25 of angle irons 14 (see also FIG. 5A). This is facilitated through the use of strong coil or compression springs 18 (see FIG. 5) which extend centrally into chamber 20 of poles 12 and 12'. An end stop 19 is provided at the inner end of each spring 18. An inner end of stop 19 is shown as line 23 in FIGS. 5 and 5.

The rigid protective panel 17 is preferably a plastic sheet, and is to be appreciated that multiple plastic sheets may be employed for strengthening the protection of a door or window. The elongate members 12 or 12' are telescoping and generally expandable toward the frame of the window 16, and may be employed to support large sheets of plastic against a window 16 or sliding doors, as is more fully described below. See also FIGS. 2 and 4.

Figure 5:
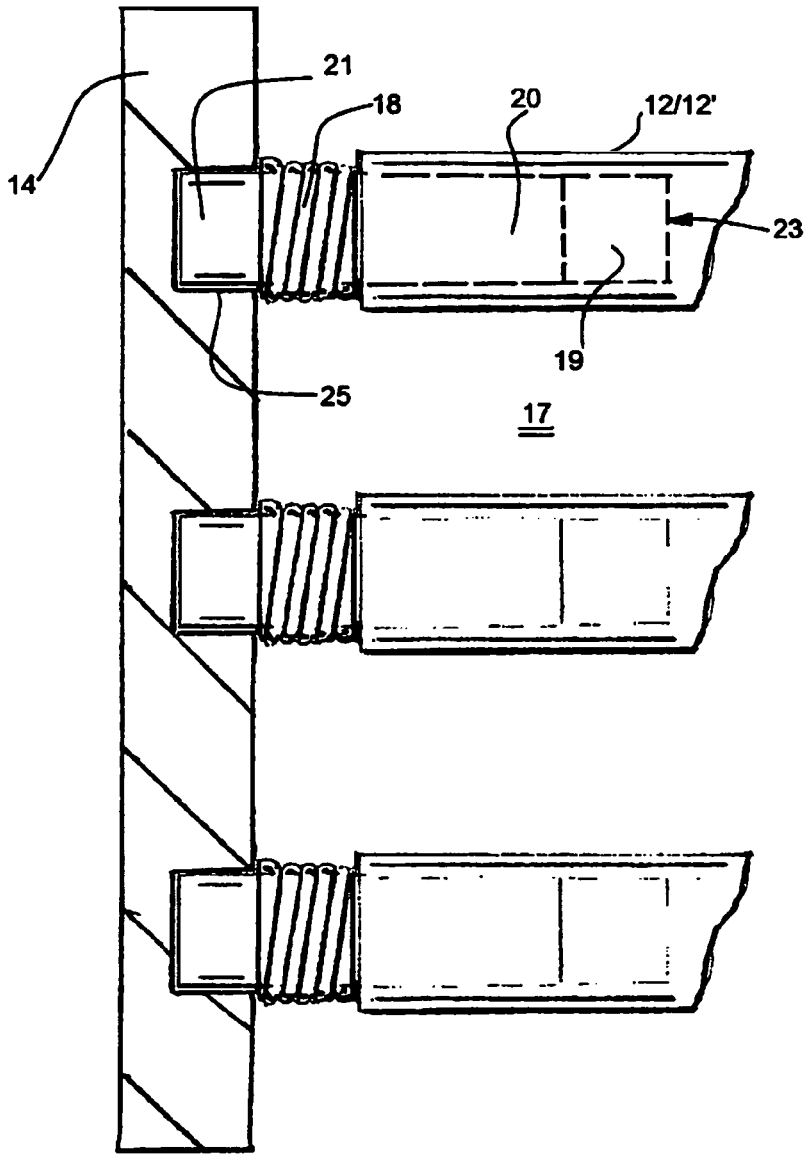
FIG. 5 is an exploded view of a coupling member securing the multiple protecting members against the rigid protective panel, according to an embodiment of the invention.

In use, a coupling member is an angle iron 14 brackets which is employed for securing the poles 12 or 12' against the plastic sheet 17. As illustrated in FIG. 5, each end 21 of the poles is inserted in the angle iron 14, thereby securing the poles against the plastic sheet 17. It will be appreciated that other coupling members, similar to the angle iron, such as latches, hooks, and the like, may be employed for securing the poles against the plastic sheet. This is further discussed with reference to FIG. 9 below.

In FIG. 2 is shown an assembly for the provision of additional pressure against the plastic sheet 17, to thereby further stabilize the sheet 17 relative to window 16. Therein is shown a simple screw 15 threaded within the member 12 in which screw 15 is rotatable by wing nut or knob 10 so that pressure can be transmitted to washer 22 and, in turn, to plastic sheet 17.

Figure 4:
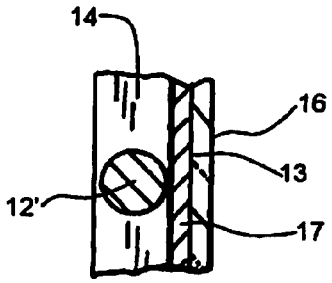
FIG. 4 is a cross sectional view of the fastener securing the protecting member to the protection assembly for covering a window/door, according to an embodiment of the invention.

FIG. 4 shows the contact between pole 12' at point 13 and directly against plastic 17 which abuts glass 16 of window 11.

Figure 3:
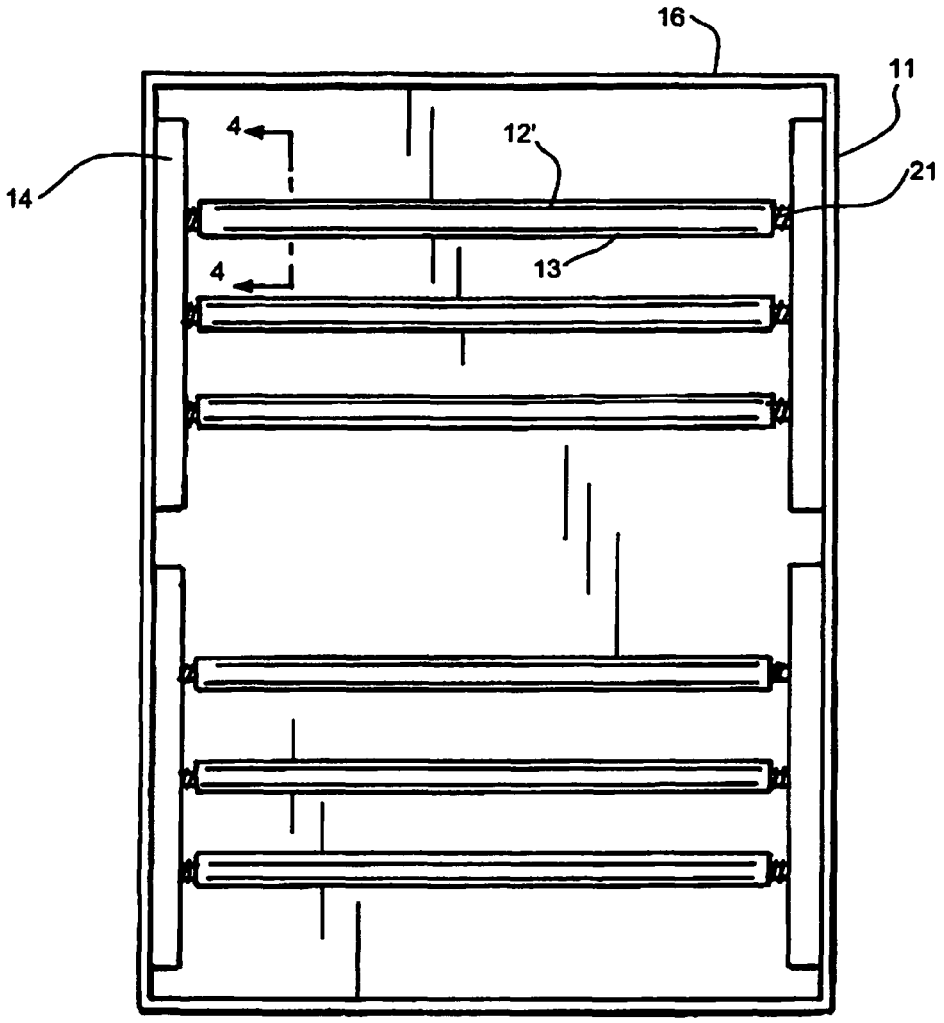
FIG. 3 is a front view of a protection assembly for covering a window/door, according to an embodiment of the invention.
Figure 5A:
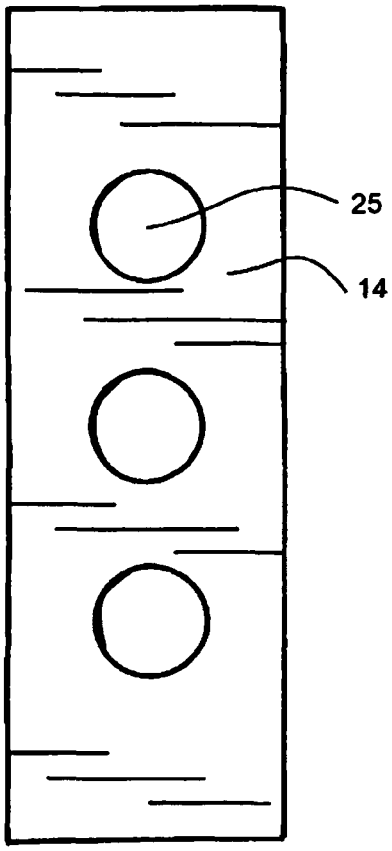
FIG. 5A is a plan view of the window jamb inserted angle iron of the invention.

In accordance with an embodiment of the present invention, the assembly further includes multiple threaded 21/25 fasteners as shown in FIGS. 5 and 5A for securing the plastic sheet 17. In use, the angle irons 14 include multiple receiving apertures 19, positioned on its surface for receiving the ends 17 of poles 12' through threaded apertures 25 of the angle irons 14. Therefore, a user generally inserts the end 17 into an aperture, and subsequently, following a clockwise motion, no opposite end of the pole is also received by the angle iron at the opposite side of the system as shown in FIG. 3.

Figure 6:
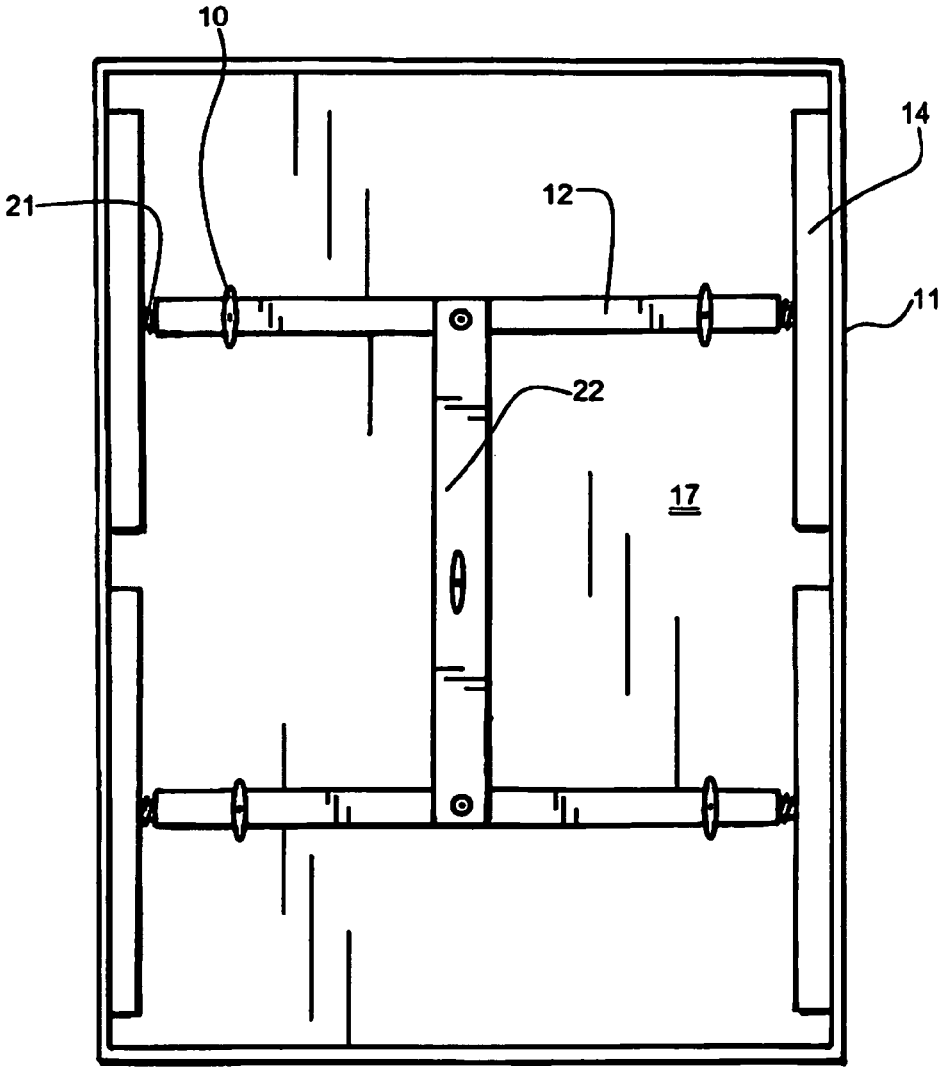
FIG. 6 is a front elevational view of a further embodiment of the invention.

In FIG. 6 is shown an alternate embodiment for securing poles 12' to a plastic sheet 17. This approach reduces the number of members or poles 12' that are needed, by making use of a vertical planer member 34 to connect two horizontal poles 12'. The cross-sectional views 7-7 and 7A-7A of FIG. 6 show an embodiment of the embodiment of FIG. 6 that assists in the securement to the plastic panel to the window jamb 16 to which angle irons 14 are attached. Element 10 in FIG. 6 also indicates that the assembly of FIG. 2 may be used in the embodiment of FIG. 6.

Figure 9:
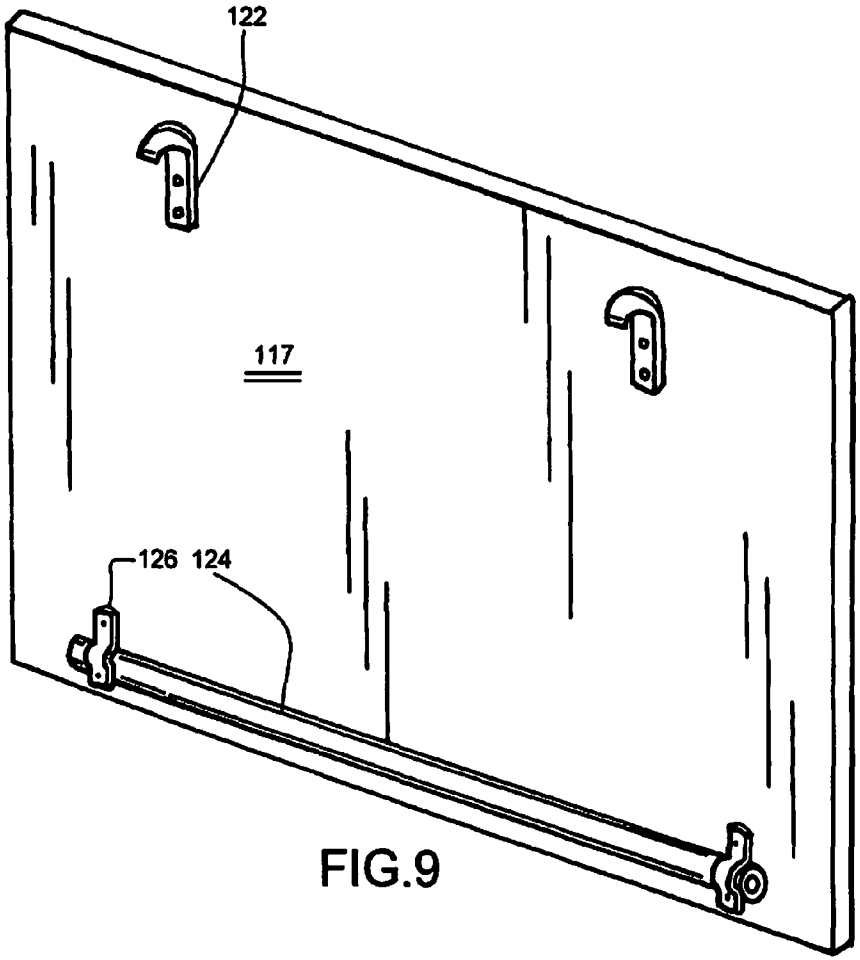
FIG. 9 is a perspective view of a covering panel for use with the embodiment of FIG. 8
Figure 7A:
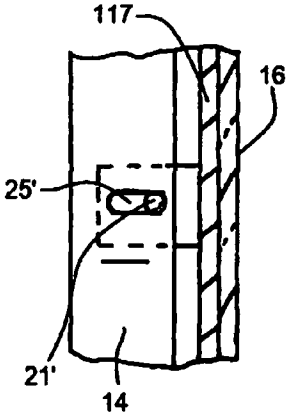
FIG. 7A is a cross-sectional view taken along Line 7A-7A of FIG. 6.
Figure 7:
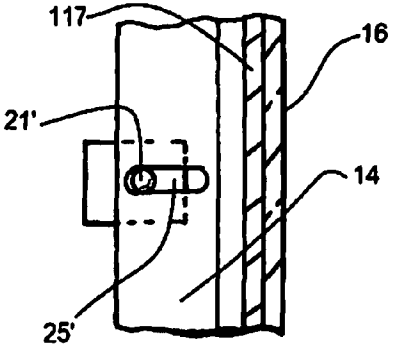
FIG. 7 is a cross-sectional view taken along Line 7-7 of FIG. 6.
Figure 8:
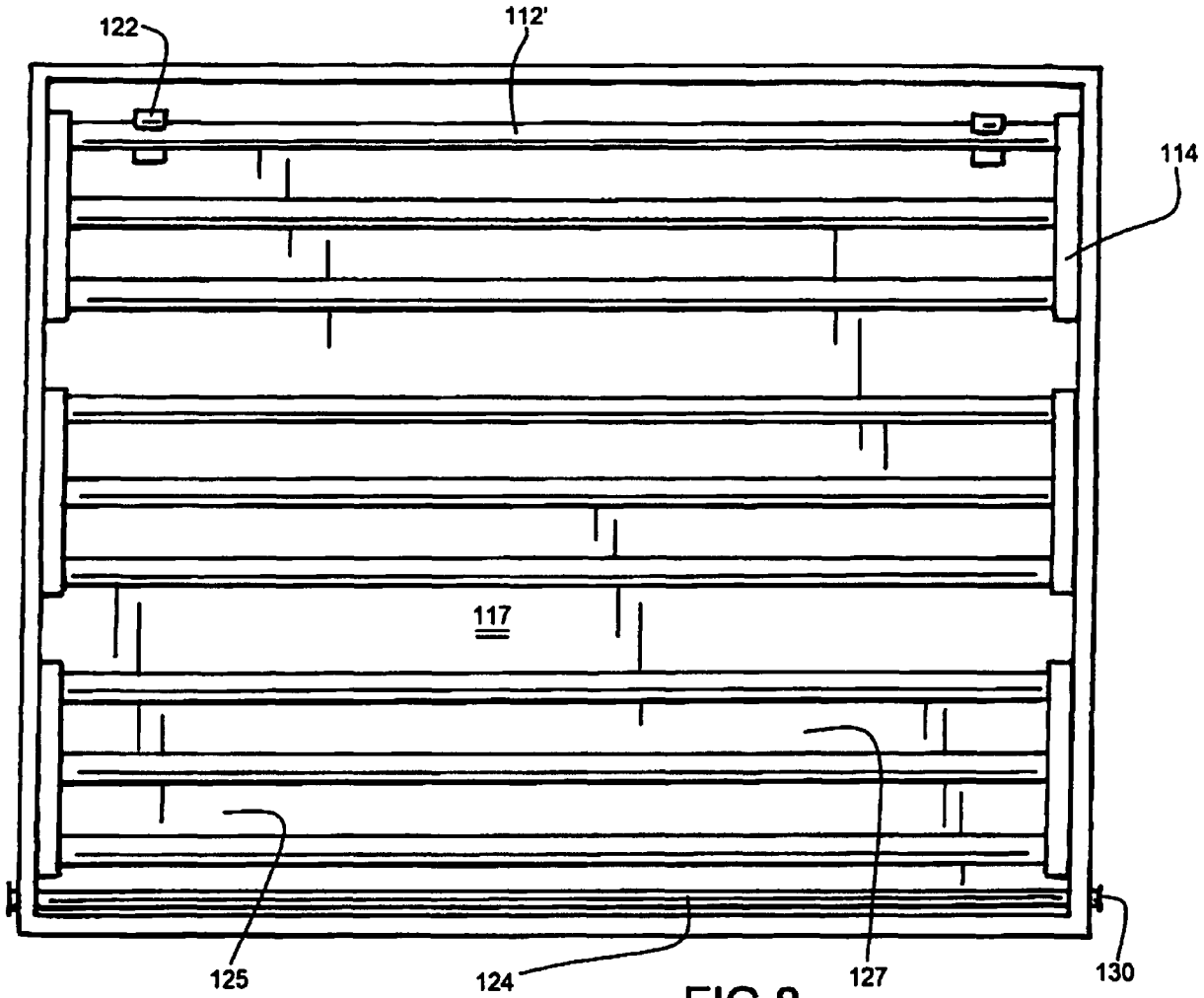
FIG. 8 is a front view of a protection assembly for covering a sliding door according to yet another embodiment of the invention.
Figure 10:
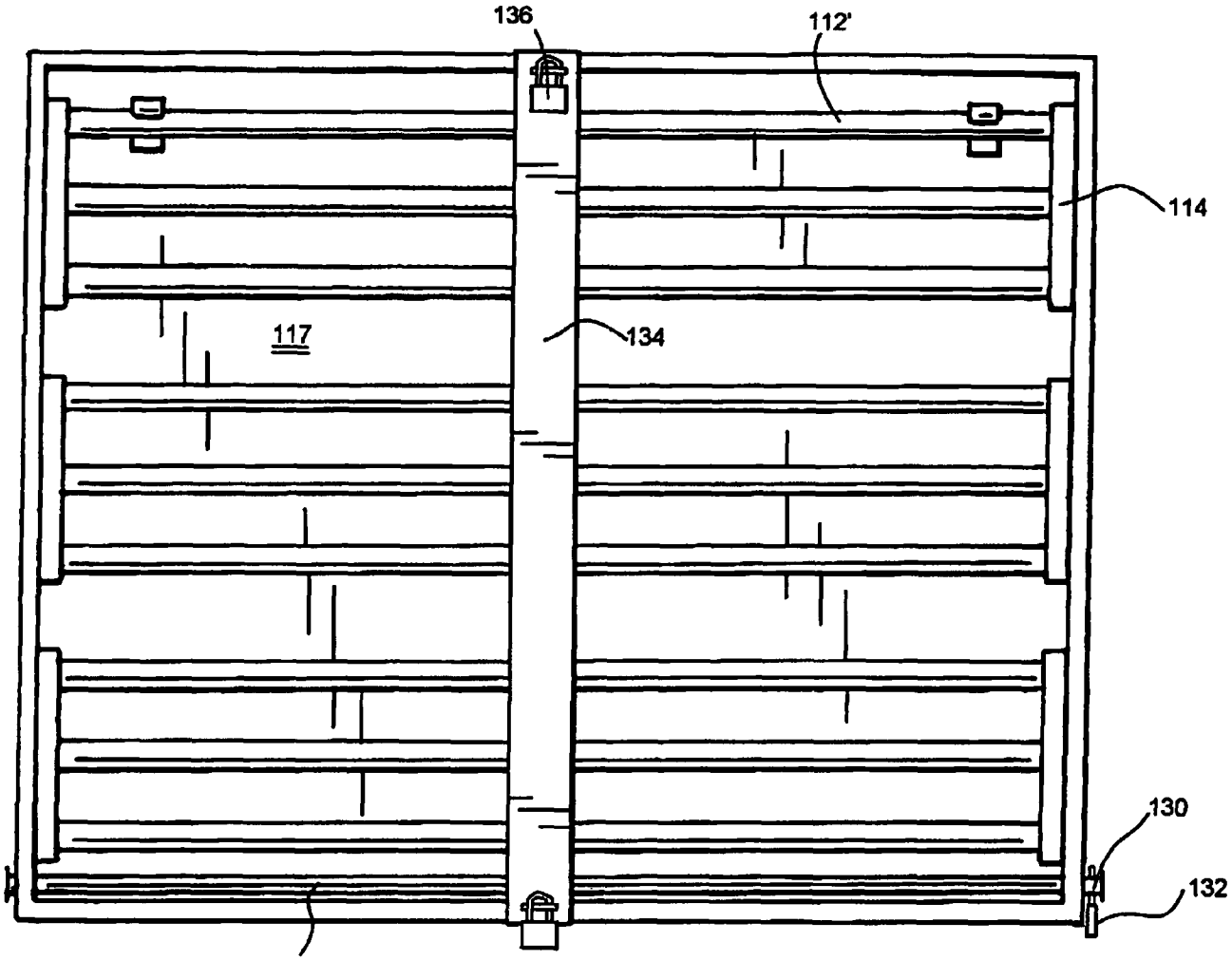
FIG. 10 is a perspective view of a protection assembly for covering a commercial window/door, according to yet another embodiment of the invention.

With reference to FIGS. 8 to 10, a protection assembly for covering of sliding doors includes loop hinges 122 configured to be coupled to poles 112'. Additionally, the poles 112' include end at each of its ends, a protruding member similar spring 18 and 21 shown in FIG. 5, thereby forming an interlocking mechanism at each end of each longitudinal member (see FIG. 8) which further may be secured by various locks 132 and 136, See FIG. 10. It is be appreciated that more than one longitudinal member may be employed, either horizontally, or vertically, or both horizontally and vertically, for supporting various types of, thereby providing further safety against theft through sliding doors, windows, and the like. For example, tube 124 (see FIGS. 8 and 9) may pass across the bottom of sliding glass doors 125 and 127 as a security measure. Bar 130 (see FIG. 8) then passes thru tube 124 to secure the entire system.

With reference to FIG. 10, a protection assembly for covering a window/door for a business in accordance with another embodiment of the invention, includes, a rigid protective panel 117 dimensioned to fit against the window/door, one or more protecting members 112 for supporting the rigid protective panel 117 against the window/door, and multiple latches positioned on the window/door for securing the protecting members against the rigid protective panel. Locks 132 and 136 are shown for tube 130 and vertical strip 134 respectively. It will be appreciated that the metal poles may be expandable or non-expandable. The assembly can include multiple hooks positioned on the window/door for supporting the plastic sheet against the frame of the window/door, as in FIGS. 8 and 9.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What I claim is:

1. A protection assembly for covering a window/door, said protection assembly comprising:

(a) at least one rigid protective panel dimensioned to fit against a frame of said window/door;

(b) at least one protecting member for supporting said at least one rigid protective panel against said frame of said window/door;

(c) at least one coupling member for coupling said at least one rigid protective panel against said frame of said window/door, and for further securing said at least one protecting member against said at least one rigid protective panel;

(d) a plurality of fasteners for securing said at least one protecting member against said at least one rigid protective panel, said plurality of fasteners being threaded fasteners in which said at least one rigid protective panel further comprises at least one receiving member positioned on its surface, said at least one receiving member being configured to receive each fastener of said plurality of fasteners through an orifice of said at least one protecting member, said orifice being a threaded orifice; and (e) at least one longitudinal member configured to be coupled to said at least one protecting member in which said at least one longitudinal member comprises at least one slot at each of its edges, said at least one slot being configured to mate with at least one protruding member positioned on surface of said frame of said window/door, thereby forming an interlocking mechanism.

2. The assembly of claim 1, in which said at least one longitudinal member comprises at least one slot at each of its edges, said at least one slot being configured to mate with at least one protruding member positioned on surface of said frame of said window/door, thereby forming an interlocking mechanism.

3. The assembly of claim 1, wherein said interlocking mechanism is secured by at least one lock.

4. The assembly of claim, 1 wherein said at least one rigid protective panel is a plastic sheet.

5. The assembly of claim 1, wherein said at least one protecting member is a telescopic pole.

6. The assembly of claim 1, wherein said at least one coupling member is a bracket.

7. The assembly of claim 1, wherein said at least one protecting member is metal pole.

8. A protection assembly for covering a window/door, said protection assembly comprising:

(a) at least one rigid protective panel dimensioned to fit against said window/door;

(b) at least one protecting member for supporting said at least one rigid protective panel against said window/door in which said at least one protecting member is a metal pole; and (c) a plurality of latches positioned on said window/door for securing said at least one protecting member against said at least one rigid protective panel; and (d) a plurality of hooks positioned on said window/door for supporting said at least one rigid protective panel against a frame of said window/door.

9. The assembly of claim 8, wherein said at least one rigid protective panel is a plastic sheet.

* * * * *